United States Patent [19]

Aono

[11] 4,088,095

[45] May 9, 1978

[54] CLOSED-LOOP MIXTURE CONTROL SYSTEM FOR AN INTERNAL COMBUSTION ENGINE USING A DIFFERENTIAL AMPLIFIER WITH A REFERENCE VOLTAGE VARIABLE ACCORDING TO ENGINE OPERATING PARAMETERS

[75] Inventor: Shigeo Aono, Seki, Japan

[73] Assignee: Nissan Motor Company, Limited, Japan

[21] Appl. No.: 686,805

[22] Filed: May 17, 1976

[30] Foreign Application Priority Data

May 20, 1975 Japan ..... 50-59297

[51] Int. Cl.[2] ..... F02M 7/00; F02B 3/00

[52] U.S. Cl. ..... 123/32 EE; 123/119 EC; 60/285

[58] Field of Search ..... 123/32 EE, 119 EC; 60/285, 276

[56] References Cited

U.S. PATENT DOCUMENTS 3,745,768 7/1973 Zechnall ..... 60/285

3,831,564 8/1974 Schmidt ..... 123/32 EA 3,986,352 10/1976 Casey ..... 60/285

*Primary Examiner*—Ronald B. Cox

[57] ABSTRACT

A closed-loop mixture control system for an internal combustion engine comprises an exhaust composition sensor generating an output whose waveform is nonlinear and substantially symmetrical with respect to a predetermined air-fuel ratio, a differential amplifier connected to the composition sensor for comparison with a reference voltage which is variable in accordance with the engine operating parameters, and an integral controller for integrating the output from the differential amplifier. The differential amplifier output is normally symmetrical with respect to a predetermined value of the reference voltage to control the air-fuel ratio at a desired value that corresponds to the maximum conversion efficiency of a catalytic converter. Under transient conditions, the reference voltage is varied so that the differential amplifier generates an unsymmetrical voltage which, when integrated, produces a bias voltage that shifts the air-fuel ratio to a value preferable for the transient engine operating conditions.

2 Claims, 2 Drawing Figures

CLOSED-LOOP MIXTURE CONTROL SYSTEM FOR AN INTERNAL COMBUSTION ENGINE USING A DIFFERENTIAL AMPLIFIER WITH A REFERENCE VOLTAGE VARIABLE ACCORDING TO ENGINE OPERATING PARAMETERS

The present invention relates generally to mixture control system for an internal combustion engine, and in particular to a closed-loop mixture control system using an exhaust composition sensor of the type having a nonlinear output characteristic and a differential amplifier to receive the output from the composition sensor for comparison with a variable reference level.

In a closed-loop mixture control systems, the concentration of a composition in the exhaust emissions is detected by a zirconium dioxide oxygen sensor to generate information as to the air-fuel ratio of the mixture supplied to the engine cylinders in order to maintain the mixture at a desired value which is optimal for reducing the noxious emission by a catalytic converter. In prior art systems, the generated information is compared to a fixed value of reference voltage by means of a comparator which provides square wave pulses of opposite polarity depending on whether the air-fuel ratio is above or below the desired value; specifically the sensor voltage is above or below the reference voltage. The prior art systems are satisfactory for normal cruise. However, it is often desirable to operate the engine at air-fuel ratios other than the optimum value for which the catalytic converter works at its maximum conversion efficiency; for example, rich mixtures (lower than the optimum ratio) for cold starting or acceleration, and lean mixtures (higher than the optimum ratio) for deceleration. Because of the binary characteristic of the comparator, the air-fuel mixture is always controlled at the optimum value for the catalytic converter.

An object of the present invention is therefore to provide a closed-loop mixture control system for an internal combustion engine which allows the air-fuel mixture to be controlled at desired values the varying engine operating parameters.

According to the present invention there is provided a closed-loop mixture control system for an internal combustion engine, which comprises an exhaust composition sensor for sensing the concentration of a composition of the exhaust emissions from the engine to generate an output having a nonlinear, substantially symmetrical waveform with respect to a predetermined air-fuel ratio, a differential amplifier having a first input connected to the output of the exhaust composition sensor and a second input connected to a variable reference voltage to generate an output representing the difference between the signals applied to the first and second inputs, an integral controller for integrating the signal from the differential amplifier, means for supplying air-fuel mixture to the engine in accordance with the signal from the integral controller, and means for controlling the magnitude of the reference voltage in accordance with an engine operating parameter so that the differential amplifier generates an output having an unsymmetrical waveform with respect to the controlled reference voltage, whereby the integral controller produces a bias voltage that maintains the air-fuel ratio at a desired value other than said predetermined air-fuel ratio.

The feature of the present invention resides in the use of a differential amplifier for generating an output which is the difference between a variable reference voltage and the output from the exhaust composition sensor having a nonlinear, substantially symmetrical characteristic with respect to the stoichiometric air-fuel ratio. Under the normal steady state drive (cruising), the variable reference voltage is so controlled that the differential amplifier delivers an output waveform which is symmetrical with respect to the reference voltage, as the result of which the air-fuel ratio is maintained at the stoichiometric value. When transient conditions exist, such as acceleration or deceleration, the reference voltage is varied in accordance with the varying engine parameters. The output from the differential amplifier is varied so that its waveform becomes unsymmetrical with respect to the new reference voltage. Upon integration of this signal by the integral controller, a bias voltage is derived which serves to maintain the air-fuel ratio at a value other than the stoichiometric value.

The invention will be further described with reference to the accompanying drawings, in which.

Figure 1:
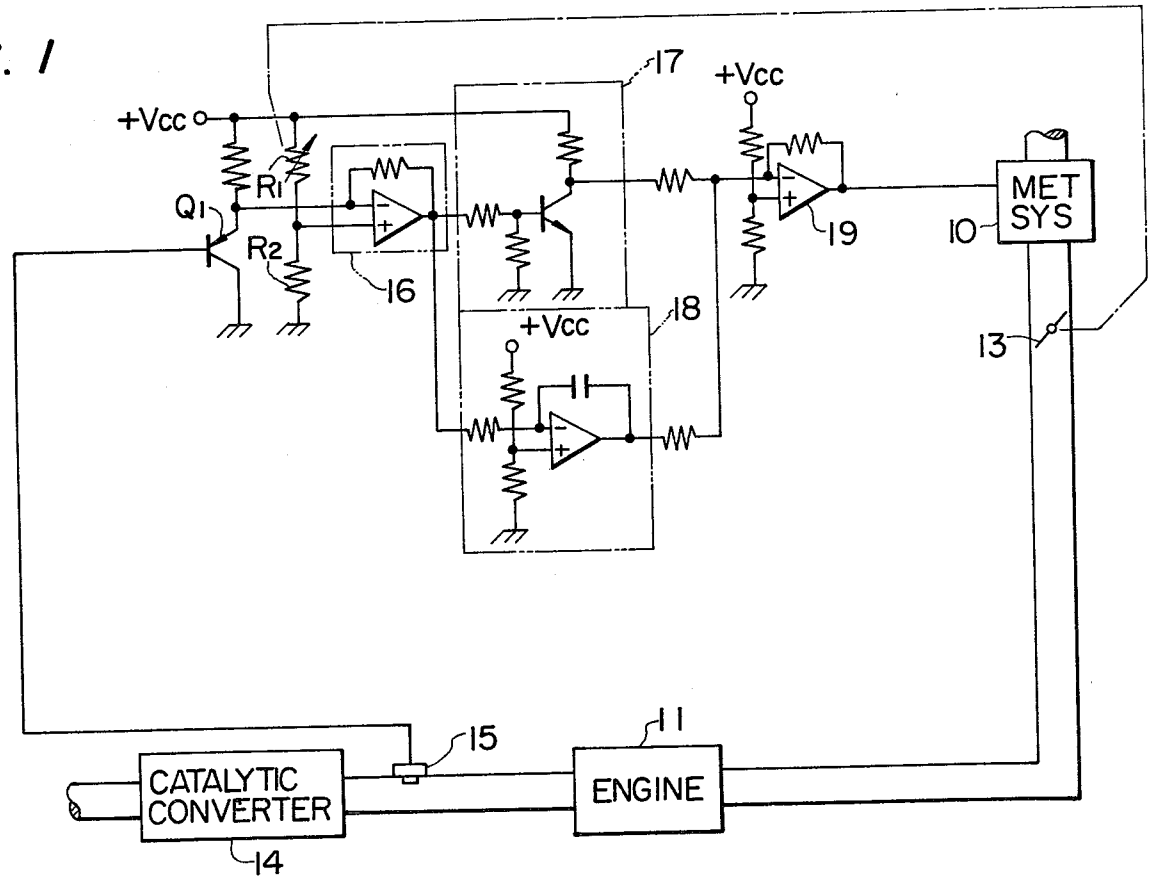
FIG. 1 is an embodiment of the invention.

Referring now to FIG. 1 a closed-loop mixture control system embodying the invention is schematically illustrated. Air-fuel metering system 10 supplies air-fuel mixture to the cylinders of an internal combustion engine 11 through inlet pipe 12 in which a throttle valve 13 is disposed in conventional manner. A three-way catalytic converter 14 is provided at the exhaust side of the engine 11 to convert noxious emissions into harmless water vapor and carbon dioxide. An exhaust composition sensor 15, such as a zirconium dioxide oxygen sensor, is mounted on the exhaust pipe between the engine 11 and converter 14 to detect the oxygen concentration of the exhaust emissions. The oxygen sensor 15 provides an output which varies sharply in amplitude at the stoichiometric air-fuel ratio so that the output characteristic curve has a linear steep transitional section and nonlinear section which are symmetrical with each other with respect to the linear section. The sensor output is applied to the base of a transistor Q which forms a high-impedance circuit for a differential amplifier 16 which receives the signal from the emitter of transistor Q at its inverting input for comparison with a variable reference DC voltage from a voltage divider $R_1$, $R_2$. The resistor $R_1$ is variable and its wiper tap is operatively connected to the throttle valve 13 to vary its resistance in accordance with the throttle position, so that the variable reference DC voltage at the noninverting input of the differential amplifier 16 is related to the throttle position. The difference between the voltages at the inverting and non-inverting inputs of the amplifier 16 represents the air-fuel ratio of the mixture supplied to the engine and a desired value at which the air-fuel ratio is to be controlled, and is represented by the sense and magnitude of the output from the differential amplifier 16. A proportional controller 17 and an integral controller 18 are connected to the output of differential amplifier 16 for amplification of the difference signal in accordance with the proportional and integral amplification characteristics in order that the fuel quantity is varied in a sense opposite to the sign of the output from the differential amplifier 16. The outputs from the controllers 17 and 18 are applied to the input of a summation amplifier 19 to provide an additive sum of the two signals. The output from the summation amplifier 19 is in turn applied as a control signal to the metering system 10 which supplies air-fuel mixture to the engine 11 in accordance with the combined outputs from the controllers 17, 18.

Figure 2:
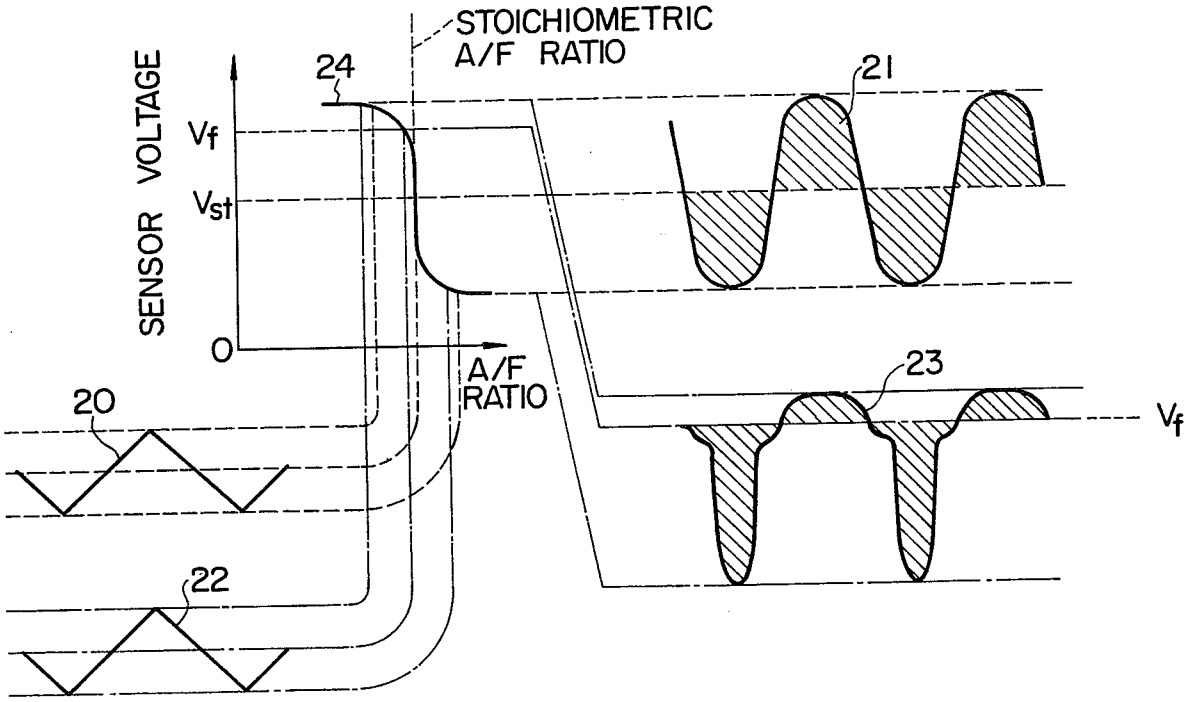
FIG. 2 is a graphic illustration useful for understanding the invention.

FIG. 2 illustrates the operation of the closed-loop mixture control system of the invention wherein the air-fuel ratio is controlled at a value optimal for a particular engine operating condition. When the reference voltage from the voltage divider circuit $R_1$, $R_2$ is held at Vst which is assumed as the stoichiometric air-fuel ratio and the control voltage has varied as indicated by waveform 20 with which the air-fuel ratio is varied, the output from the differential amplifier 16 will vary as indicated by waveform 21 which is symmetrical with respect to voltage level Vst so that the mixture ratios are maintained at the stoichiometric value. This condition exists for cruising conditions. For full throttle operations, the resistor $R_1$ is varied corresponding to the full throttle position so that the reference voltage is increased to Vf. Because of the curved knee portions of the sensor output characteristic as indicated at 24, the output from differential amplifier 16 will have a waveform 23 which is unsymmetrical with respect of Vf when a similar control voltage 22 is applied to the metering system 10. The unsymmetrical bipolar output has a greater negative polarity amplitude than the positive polarity amplitude. Since the negative polarity output from varies the air-fuel ratio to the richer mixture side, the engine is operated with a richer mixture than stoichiometry. This is analogous to the fact that the steep transitional section of the output curve has shifted toward the richer side from stoichiometry. The integral controller 18 will then produce a positive bias voltage which is substantially equal to the net voltage of the bipolar output. This bias or offset voltage together with the output from the proportional control amplifier 17 serves to vary the air-fuel ratio toward the rich mixture side as described above. Conversely, for part throttle operations in which lean mixture is desired, the reference voltage is lowered in accordance with the throttle position so that the sensor 15 output produces a positive DC component which, when integrated, will produce a negative bias voltage from the output of integral controller 18 so that the air-fuel ratio is biased toward the lean mixture.

What is claimed is:

1. A closed loop fuel control system for an internal combustion engine including means for supplying air and fuel thereto in variable ratio and exhaust means including a catalytic converter which, when supplied with exhaust gases containing air and fuel in a certain ratio, provides simultaneous oxidation of unburned fuel and reduction of nitrogen oxides, comprising:

an oxygen sensor for generating an output signal at one of high and low voltage levels depending upon whether the air to fuel ratio in said exhaust means is richer or leaner than a predetermined value and characterized by a nonlinear, substantially symmetrical voltage transition between said high and low voltage levels with respect to said predetermined value;

means for generating a reference voltage signal of variable magnitude representing an operating parameter of the engine;

a differential amplifier having a first input connected to said reference voltage generating means, the output from said differential amplifier having an unsymmetrical voltage waveform with respect to a voltage level that corresponds to said predetermined value of the air-fuel ratio;

integral and proportional control means connected to the output of said differential amplifier for adjusting said air and fuel supply means to vary the ratio of air and fuel supplied to said engine in response to the direction of the deviation of the output signal of said oxygen sensor from the magnitude of said reference voltage signal, whereby said adjustment reduces the deviation of the ratio of air and fuel in the exhaust means from said certain ratio under varying operating parameter of said engine.

2. A closed-loop mixture control system as claimed in claim 1, wherein said variable reference control means is connected to a throttle valve such that the reference voltage is varied in accordance with the position of the throttle valve.

* * * * *